United States Patent [19]

Imao et al.

[11] Patent Number: 5,028,374

[45] Date of Patent: Jul. 2, 1991

[54] METHOD OF MANUFACTURING A MOLDED WOODEN PRODUCT

[75] Inventors: Eiichi Imao, Nagoya; Sadao Kieda, Toyota; Yoshio Taguchi, Toyota; Hideaki Takahashi, Toyota, all of Japan

[73] Assignee: Toyota Jidosha Kabushiki Kaisha, Toyota, Japan

[21] Appl. No.: 472,447

[22] Filed: Jan. 29, 1990

Related U.S. Application Data

[63] Continuation of Ser. No. 913,720, Sep. 30, 1986, abandoned.

[30] Foreign Application Priority Data

| | | | |
|---|---|---|---|
| Oct. 16, 1985 | [JP] | Japan | 60-230483 |
| Dec. 6, 1985 | [JP] | Japan | 60-274665 |
| Dec. 6, 1985 | [JP] | Japan | 60-274667 |
| Dec. 6, 1985 | [JP] | Japan | 60-274669 |
| Dec. 6, 1985 | [JP] | Japan | 60-274670 |
| Dec. 7, 1985 | [JP] | Japan | 60-275267 |
| Dec. 7, 1985 | [JP] | Japan | 60-275268 |
| Dec. 9, 1985 | [JP] | Japan | 60-276607 |
| Dec. 9, 1985 | [JP] | Japan | 60-276613 |
| Dec. 10, 1985 | [JP] | Japan | 60-277438 |
| Dec. 10, 1985 | [JP] | Japan | 60-277439 |
| Dec. 10, 1985 | [JP] | Japan | 60-277441 |
| Dec. 10, 1985 | [JP] | Japan | 60-277443 |
| Dec. 10, 1985 | [JP] | Japan | 60-277444 |
| Dec. 12, 1985 | [JP] | Japan | 60-279842 |
| Dec. 17, 1985 | [JP] | Japan | 60-283863 |

[51] Int. Cl.[5] ..... B27N 5/00

[52] U.S. Cl. ..... 264/517; 264/113; 264/119; 264/121; 425/80.1

[58] Field of Search ..... 264/517, 518, 109, 121, 264/120, 118, 119, 113, 40.1, 40.3; 425/80.1; 162/150, 164.1, 194, 223, 224, 225, 226

[56] References Cited

U.S. PATENT DOCUMENTS

| | | | |
|---|---|---|---|
| 2,459,804 | 1/1949 | Francis | 264/119 |
| 2,471,932 | 5/1949 | Chaplin | 162/223 |
| 2,624,079 | 1/1953 | Duvall | 264/113 |
| 2,811,195 | 10/1957 | Kloss | 264/517 |
| 3,025,202 | 3/1962 | Morgan et al. | 264/121 |
| 4,440,708 | 4/1984 | Haataja et al. | 264/109 |
| 4,495,119 | 1/1985 | Chung | 264/37 |
| 4,568,581 | 2/1986 | Peoples, Jr. | 428/35 |
| 4,592,708 | 6/1986 | Feist et al. | 425/80.1 |
| 4,666,647 | 5/1987 | Enloe | 264/121 |

FOREIGN PATENT DOCUMENTS

| | | | |
|---|---|---|---|
| 2743873 | 4/1979 | Fed. Rep. of Germany | 264/120 |
| 53-43779 | 4/1978 | Japan . | |
| 54-124081 | 9/1979 | Japan . | |
| 56-9480 | 1/1981 | Japan . | |

*Primary Examiner*—Mary Lynn Theisen
*Attorney, Agent, or Firm*—Finnegan, Henderson, Farabow, Garrett and Dunner

[57] ABSTRACT

A binder, a water-repelling agent, and a mold release agent are added to wooden fibers obtained by splitting wood chips. This mixture is collected into a body having a particular shape without being formed into a mat. The collected body is compression molded under heat to make a molded wooden product.

13 Claims, 14 Drawing Sheets

METHOD OF MANUFACTURING A MOLDED WOODEN PRODUCT

This application is a continuation of application Ser. No. 06/913,720 filed Sept. 30, 1986, now abandoned.

BACKGROUND OF THE INVENTION

1. Field of the Invention

This invention relates to a method of manufacturing a molded wooden product by the compression molding under heat of a mass of wooden fibers containing a binder.

2. Description of the Prior Art

A molded wooden product of the type to which this invention pertains has a smaller weight than plywood and is superior in resistance to heat, water and moisture. Moreover, it is strong for its thickness. It is typically known as hardboard and is used for a wide range of applications including the decoration of the interior of houses, furniture or automobiles and the manufacture of television or stereo cabinets.

This kind of product has hitherto been manufactured by a method which will hereinafter be described. Wood chips are treated with steam having a temperature of 160° C. to 180° C. in a steaming tank in a splitting machine and are thereby loosened. The loosened chips are split into fibers by a splitting disk. The fibers are dried with hot air. Long fibers, such as of hemp or polypropylene, are added to the wooden fibers to improve their drawability. A binder composed of a phenol resin is added to bond the fibers. A water-repelling agent, such as rosin or paraffin, is also added to the fibers. The fibers and the additives are carefully mixed. The material which has been prepared as hereinabove described is formed into a stack having an appropriate thickness. The stack is lightly compressed under heat by a roll press to form a mat having a thickness of, for example, 10 to 40 mm, which is easy to carry. The mat is cut and placed in a mold in which it is compression molded at a temperature of 180° C. to 220° C. into an appropriately shaped product.

The method essentially includes the step of forming the mat and the step of cutting it into a particular shape. It is complicated and inefficient. Moreover, the mat is cut to a size which is larger than that of the final product and the excess of the material is cut away from the product. This is a waste of the material and the corresponding reduction of yield leads to a rise in the cost of production. The manufacture of a molded product having a deeply drawn portion from a single mat requires the use of a mat containing a large proportion (about 17%) of costly hemp fibers. Insofar as hemp fibers are used, it is necessary to add an extra amount of a synthetic resin. The product is, therefore, expensive.

Attempts have been made to form a mat containing a large amount or high percentage of wooden fibers preliminarily into the shape of a product before its final molding by treating it with steam to soften it and improve its deep drawability. The additional steps of manufacture, however, give rise to additional costs, for example, for equipment.

Also known is a wet molding method. A mixture of the split fibers prepared as hereinabove described, a synthetic resin, and cellulose paper are dispersed in water. The dispersion is subjected to filtration under pressure and compression, as when paper is made. The compressed product is compression molded under heat.

This method is, however, necessarily expensive as it requires the use of special equipment for the pressurized filtration and compression of the material.

SUMMARY OF THE INVENTION

It is an object of this invention to provide a method which can be used to manufacture a molded wooden product of high quality and, moreover, can achieve an improved level of productivity and an improved yield.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention as embodied and broadly described herein, the method of this invention comprises causing a material containing wooden fibers and a binder to gather into a mass of low density, forming a selected shape, and compressing the mass under heat in a mold.

The wooden fibers can be obtained, for example, by splitting wood chips. There is no particular limitation to the wood or splitting method employed. It is possible to use, for example, a Japanese cypress, a Japanese red pine, Japanese cedar, lauan or Japanese beech. The wood chips can, for example, be split mechanically after they have been treated with steam.

Any substance can be used as the binder if it can make up for the insufficiency of the bonding property which the wooden fibers themselves possess. Therefore, it is possible to use, for example, a thermoplastic resin such as a coumarone resin, or a thermosetting resin such as a phenolic or urea resin. In addition to the binder, it is also possible to add to the wooden fibers a water-repelling agent to improve water resistance, or a mold release agent.

A mass of low density can be obtained if the material is floated down into a zone lined with a wire net, punched metal plate, or other perforated object so that the low density mass may gather on the perforated object. The mass can also be formed by using an apparatus having a fluidizing zone for example a fluidizing vessel, which can maintain the material in a floating position and a collecting zone, for example a collecting vessel, lined with a perforated member. The two zones or vessels are brought together while evacuating the area behind the collecting vessel so that the floating material may gather on the perforated member. In either event, it is possible to obtain a body of desired size and shape by appropriately selecting the shape of the vessel into which the material is caused to gather, the surface configuration of the perforated member and the amount of the material caused to be gathered.

The collected mass or body of the material can be supplied into a mold by any method that can maintain its shape. For example, the vessel in which the body has been formed can itself be used for carrying it to the mold. It is, of course, possible to use another vessel for carrying it.

The conditions for compression molding depend on the wooden fibers and binder used, the shape of the molded product to be made, and the strength required. It is, for example, possible to carry out the compression molding at a temperature of 150° C. to 220° C. and a pressure of 20 to 80 kg/cm$^2$ for a period of 20 seconds to five minutes.

According to this invention, it is no longer necessary to form a mat and cut it into a particular shape, but it is possible to achieve a simplified operation and an improved yield, insofar as a body of material which has been collected in a particular shape can be employed for compression molding.

It is also possible to achieve an improved degree of compression moldability and to manufacture a molded product of high quality having no cavity, crack or other defect, if the body is shaped to suit deep drawing as, for example, having its thickness increased in any portion thereof that is going to be deeply drawn. The improved moldabiltiy enables not only a reduction in the amount of the binder to be added to the wooden fibers, but also eliminates the necessity for the addition of costly hemp fibers, and a drastic reduction in the cost of manufacture.

The accompanying drawings, which are incorporated in and constitute a part of the specification, illustrate one embodiment of the invention and, together with the description, serve to explain the principles of the invention.

BRIEF DESCRIPTION OF THE DRAWINGS

FIG. 3 is a perspective view showing a splitting machine;

FIG. 4 is a perspective view of a mixer;

FIG. 5 is a vertical sectional view of a device for forming a collected body of material;

FIGS. 6 and 7 are vertical sectional views of a holding vessel in two different positions, respectively;

FIGS. 8 and 9 are vertical sectional views showing a mold in two different positions, respectively;

FIG. 10 is a vertical sectional view of another example of the device for forming a collected body of material;

FIGS. 11 and 12 are vertical sectional views showing the transfer of a collected body of material from a collecting vessel in the body forming device to the holding vessel;

FIG. 13 is a top plan view of a perforated member in the holding vessel;

FIG. 14 is a vertical sectional view of still another example of the device for forming a collected body of material;

FIG. 15 is a view similar to FIG. 14, but showing a modified form of the device therein shown;

FIG. 16 is a vertical sectional view showing the step of improving the shape of a collected body of material;

FIG. 17 is a vertical sectional view of a modified collecting vessel;

FIG. 18 is a vertical sectional view of a modified holding vessel;

FIG. 19 is a fragmentary front elevational view of a needle in the holding vessel of FIG. 18;

FIG. 20 is a fragmentary front elevational view of a modified needle;

FIG. 21 is a vertical sectional view of another modified holding vessel;

FIGS. 22 to 24 are vertical sectional views of different examples of collected bodies of material; and FIGS. 25 to 27 show different ways of adding a binder, a mold release agent, or other additives to the material.

DETAILED DESCRIPTION OF THE INVENTION

Figure 1:
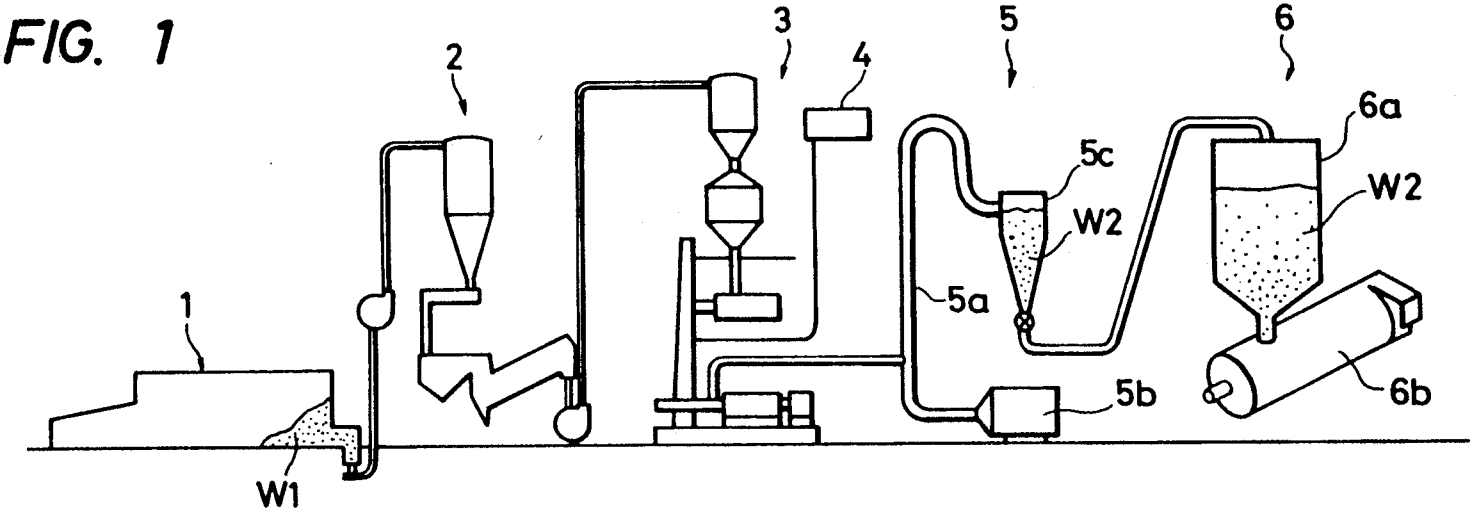
FIG. 1 is a diagrammatic view showing by way of example an apparatus which can be used for preparing a material for molding in accordance with the method of this invention.
Figure 2:
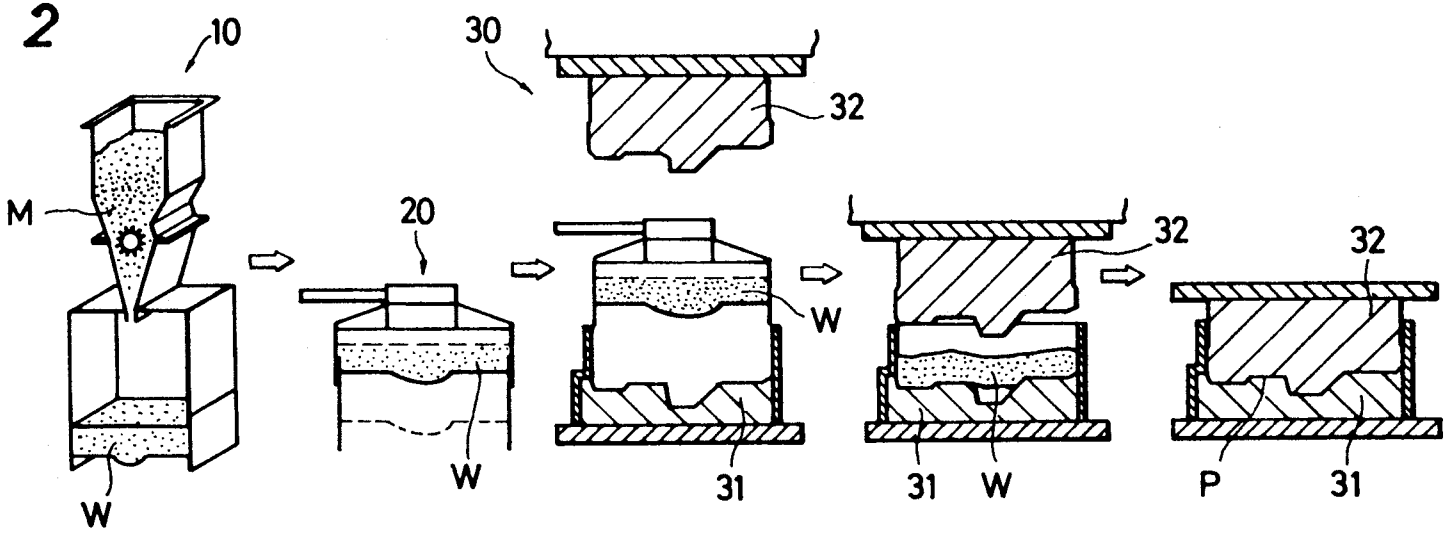
FIG. 2 is a view showing by way of example a molding process which can be employed for manufacturing a molded wooden product in accordance with the method of this invention.

The invention will now be described by way of an example with reference to the drawings. Referring first to FIGS. 1 and 2, wood chips W1 are carried from a storage tank 1 to a chip washing machine 2 in which they are washed. Then, they are carried to a splitting machine 3 in which they are treated with steam and split into fibers while a water-repelling agent is supplied from a pump 4 to the splitting machine 3. The wooden fibers W2 are carried to a drier 5. They are carried on a stream of hot air from a blower **5*b* through a hot air tube 5*a* to a cyclone 5*c*, whereby they are dried. They are then carried to a hopper 6*a* in a mixer 6 and are allowed to drop from the hopper 6*a* into the main body 6*b* of the mixer 6** in which they are mixed with a binder, a mold release agent, or other additive, whereby a fibrous mixture M is prepared.

The mixture M is transferred from the mixer 6 to a collecting zone or device 10 and is caused to float down and gather to form a collected body W of material having a particular shape. The body W is transferred to a holding zone or vessel 20 and conveyed to a mold 30 having a lower mold half 31 in which the body W is placed. The body W is heated in the lower mold half 31 and an upper mold half 32 is lowered to compress the body W, whereby a molded product P having a desired shape is manufactured.

Figure 3:
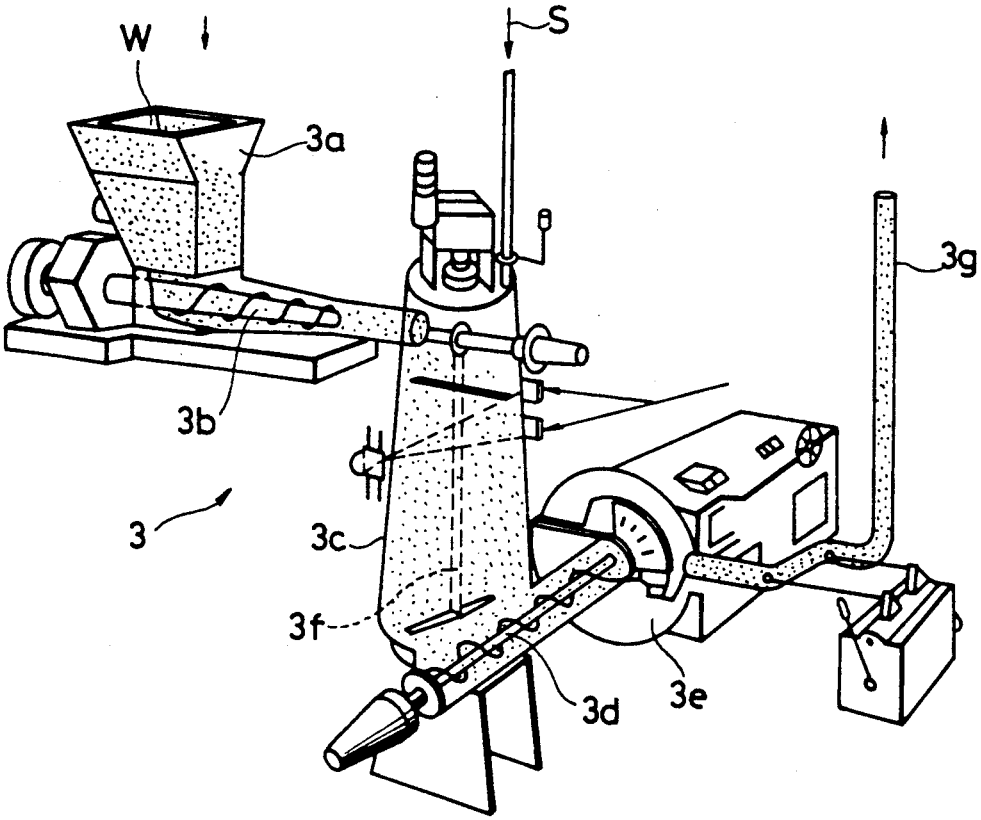
FIGS. 3 to 27 show by way of example various parts of the apparatus which can be used for carrying out the method of this invention, and the operation thereof.

The various aspects of the method and apparatus which have been described briefly will now be described in detail with reference to the other drawings. Referring first to FIG. 3, the splitting machine 3 comprises a hopper **3*a* for storing the wood chips W1 arriving from the washing machine 2 shown in FIG. 1, a first screw feeder 3*b* provided under the hopper 3*a* for feeding a constant quantity of chips W1, a steaming tank 3*c* which receives chips W1 from the feeder 3*b* and treats them with steam, a second screw feeder 3*d* provided under the tank 3*c* for receiving the chips W1 therefrom and feeding them at a constant rate, and a splitting disk 3*e* which receives the chips W1 from the second screw feeder 3*d*** and splits them into fibers mechanically.

Steam S is supplied into the tank **3*c* at its top for digesting the wood chips W1, while they are stirred by a stirring rod 3*f*. The steamed chips W1 are conveyed by the second screw feeder 3*d* to the splitting disk 3*e* and the mechanically split fibers are conveyed under pressure to the drier 5 (FIG. 1) through a tube 3*g***.

Figure 4:
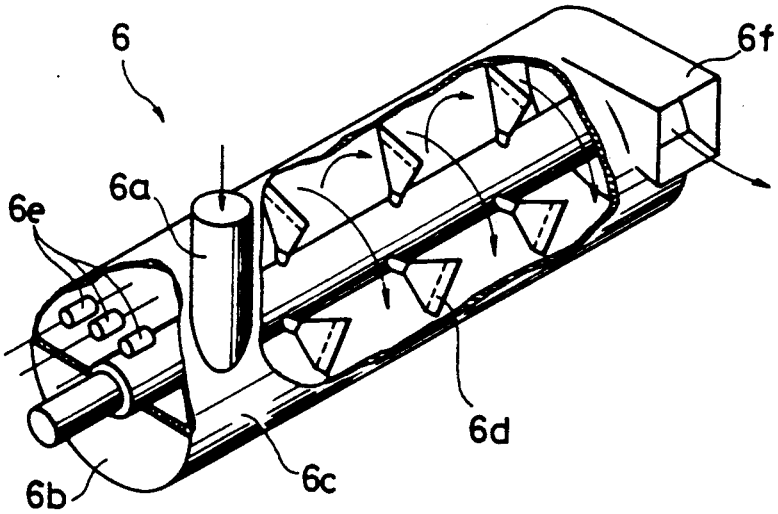

The main body **6*b* of the mixer 6 is shown in detail in FIG. 4. It comprises a cylindrical casing 6*c* in which a plurality of stirring blades 6*d* are rotatably supported. The casing 6*c* is provided adjacent to one end thereof with a port 6*a* through which it receives the wooden fibers W2 from the hopper 6*a* (FIG. 1). The casing 6*c* is also provided at one end thereof with a plurality of spray nozzles 6*e* through which a binder, such as a phenolic resin, and a water-repelling agent, such as paraffin, are supplied into the casing. The casing 6*c*** is also provided at the other end thereof with a port 6f through which the mixture M is discharged. The wooden fibers W2 entering the casing 6c through the port 6a meet the binder, water-repelling agent, or other agent entering through the spray nozzles 6e. They are fully mixed by the stirring blades 6d which are driven by means not shown. The resulting mixture is gradually conveyed toward the port 6f by the blades 6d and eventually discharged therethrough.

Figure 5:
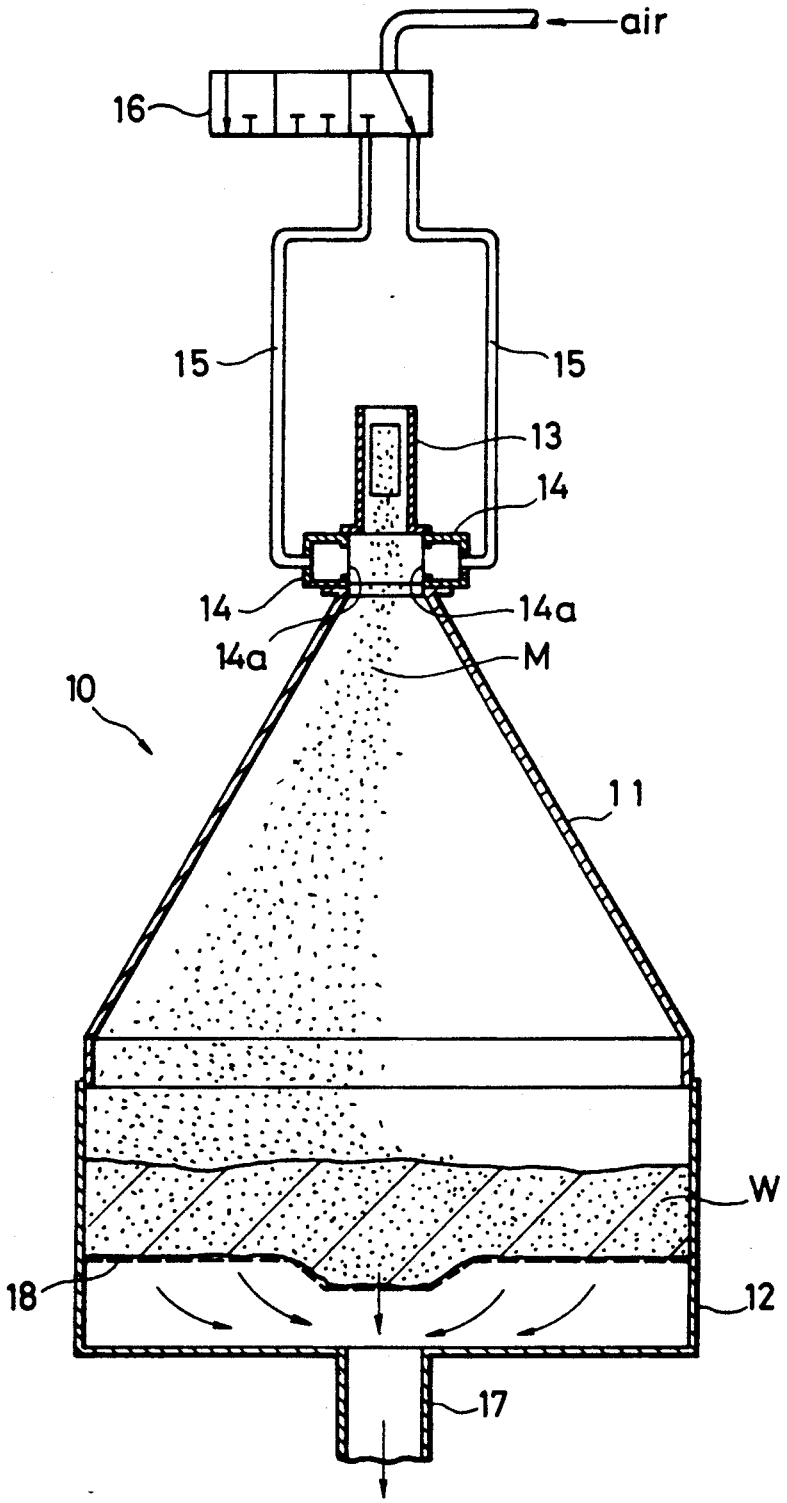

The collecting device 10 is shown by way of example in FIG. 5. It comprises a spreading vessel 11 of the roof-shaped construction formed from iron plates or like materials and a collecting vessel 12 provided under the spreading vessel 11 for collecting the mixture M in a layer therein. The spreading vessel 11 has a top opening provided with a unit 13 for spreading the mixture M and a pair of air feeders 14 each having at its inner end a port 14a through which air is blown to restrict the direction in which the mixture M is spread from the spreading unit 13 to the interior of the vessel 11. A pair of air supply tubes 15 each having one end connected to one of the air feeders 14 are connected at the other ends thereof to a switching valve 16 which switches the supply of air from one of the tubes 15 to the other. A suction pipe 17 is connected to the bottom of the collecting vessel 12 for drawing air out of the vessel 12. A perforated member 18 is provided in the vessel 12 intermediate the upper and lower ends thereof for defining the shape of the bottom of a collected body of material which is formed by the mixture M falling from the spreading unit 13. The member 18 may, for example, comprise a wire net or a punched metal plate.

In operation, the valve 16 is opened to supply air to one of the air feeders 14 through the corresponding tube 15 to form a stream of air extending from the spreading vessel 11 to the collecting vessel 12. Then the mixture M is supplied against the stream of air by the spreading unit 13. The mixture M is floated down on the air stream into the collecting vessel 12 and gradually gathers on the perforated member 18. The valve 16 is operated to switch the supply of air from one of the air feeders 14 to the other to change the direction in which the mixture M falls. This operation is repeated so that the mixture M may form a layer covering the whole area of the perforated member 18 and having a greater thickness in a particular portion or portions than in its remaining portion. The air is drawn out of the vessel 12 through the suction pipe 17, so that the mixture M may quickly gather on the perforated member 18.

As the mixture M gathers, it eventually forms a collected body W of material having a particular shape. The supply of the mixture M from the spreading u it 13 and the supply of air through the air supply pipes 15 are discontinued, whereupon the step of forming a collected body of wooden fibers is completed. The collected body W has a very low density since the material has merely been caused to gather. The body W has an increased thickness portion (or portions) of high moldability which will eventually be compressed to form a deeply drawn portion of a molded product, as will hereinafter be described in detail.

Figure 6:
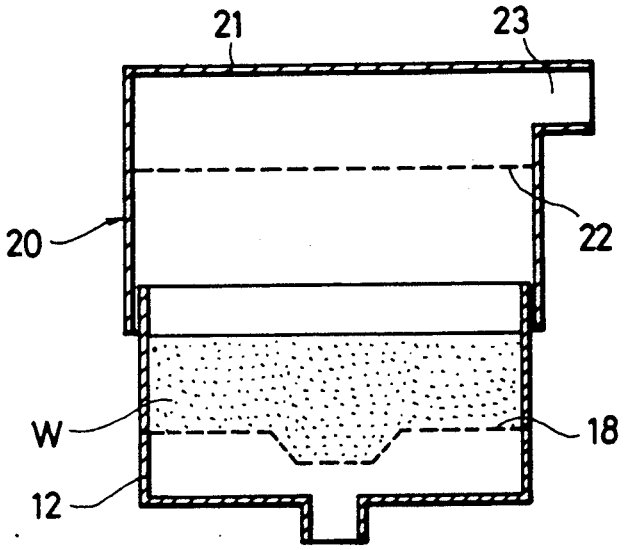
Figure 7:
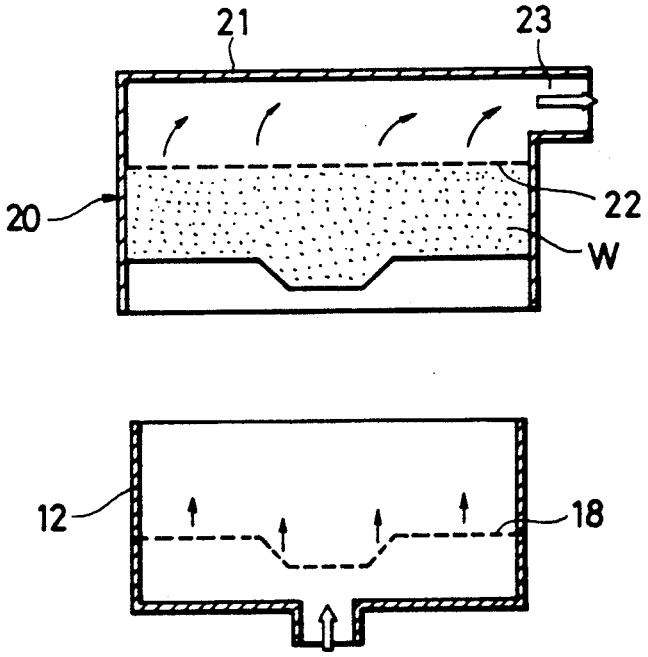

Then the collecting vessel 12 is separated from the spreading vessel 11, so that the collected body W may be transferred from the vessel 12 to the holding vessel 20, as shown in FIGS. 6 and 7. The holding vessel 20 comprises a casing 21 so shaped as to be capable of fitting on the collecting vessel 12. A perforated member 22 extends across the casing 21 and may comprise a wire net. An exit port 23 is provided at the top of the casing 21. An evacuation device (not shown) is connected to the port 23 to draw air out of the casing 21 so that the collected body W, which has a low specific gravity, may be lifted and held against the perforated member 22, as shown in FIG. 7. While the evacuation of air is continued, the holding vessel 20 is lifted and conveyed by means not shown to the mold 30 (FIG. 2). After the vessel 20 has been positioned exactly above the lower mold half 31, the evacuation of air is discontinued, whereupon the collected body W of material is placed down in the lower mold half 31, as shown in FIG. 2.

Figure 8:
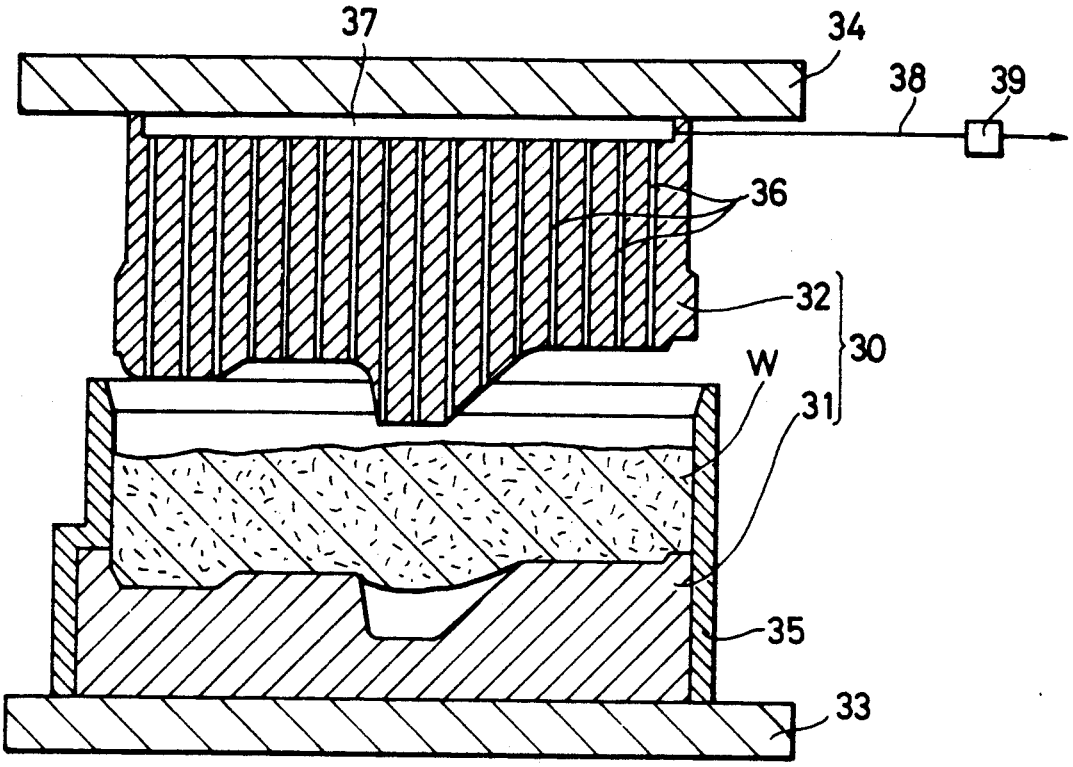
Figure 9:
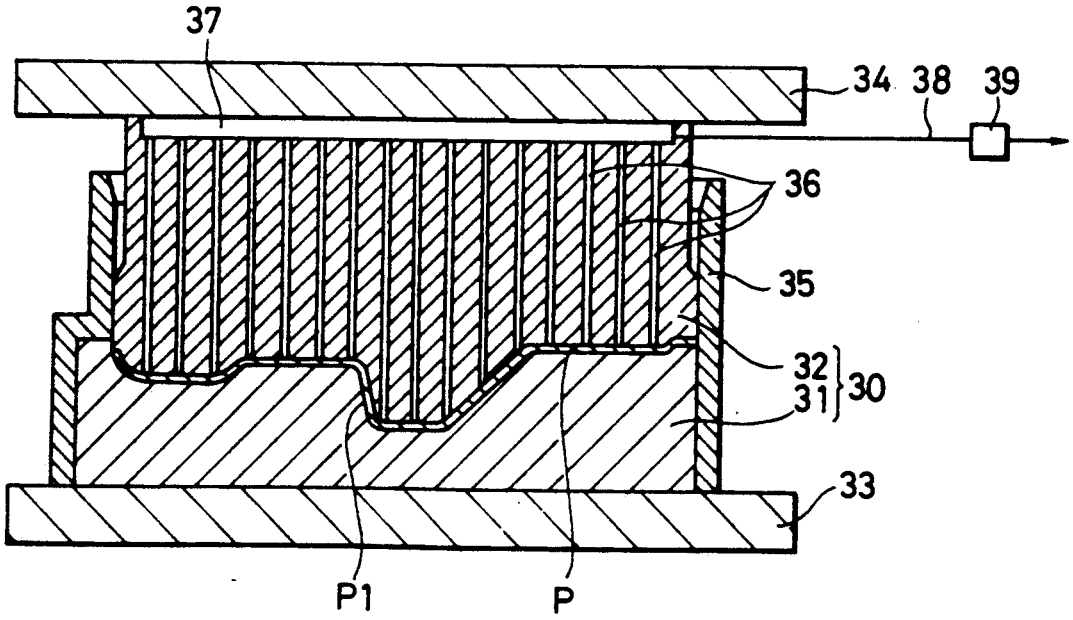

Referring to FIGS. 8 and 9, the lower half 31 of the mold 30 is secured to the upper surface of a hot plate 33, and the upper half 32 of the mold 30 is secured to the lower surface of a hot plate 34. A holding frame 35 extends along the outer periphery of the lower mold half 31 and defines thereabove an open space in which the collected body W of material is held. The upper mold half 32 is slidable along the inner surface of the frame 35. The upper mold half 32 has a plurality of gas vent holes 36 connected with a port 37 which is connected to an evacuating device (not shown) by a pipeline 38 provided with a valve 39.

The lower and upper mold halves 31 and 32 are heated by the hot plates 33 and 34, respectively, so that the mold 30 may be prepared for compression molding. The collected body W of material is supplied into the space surrounded by the frame 35, as shown in FIG. 8. Then, a ram (not shown) is lowered to compress the body W between the upper and lower mold halves 32 and 31. The body W has a gradually increasing density with an increase in the entanglement of the wooden fibers and the molding pressure is raised accordingly, while the valve 39 is opened to remove gas through the vent holes 36. As a result, there is obtained a hard and homogeneous molded wooden product P having a desired deeply drawn portion P1, as shown in FIG. 9.

Figure 10:
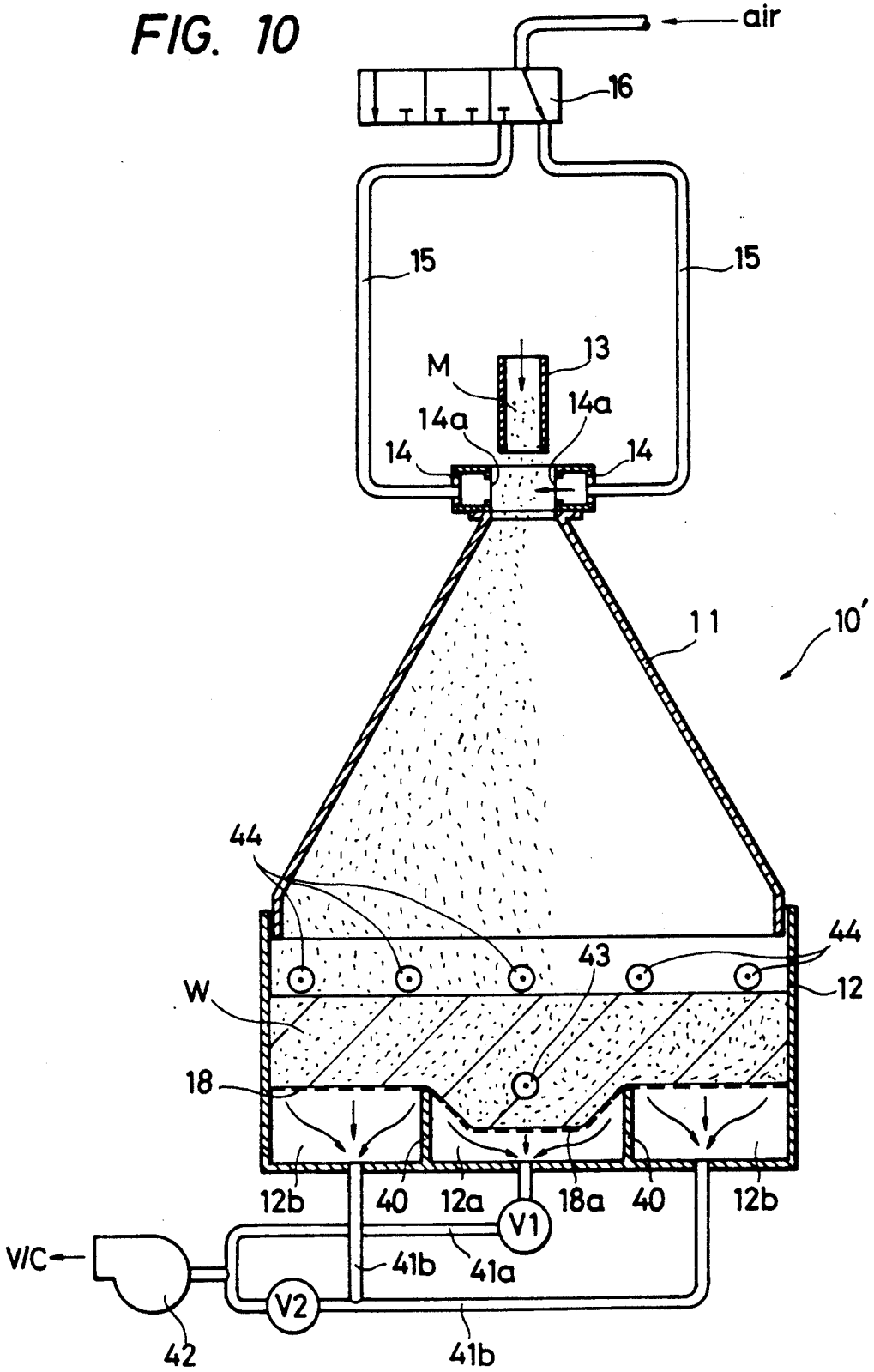

FIG. 10 shows a modified collecting device 10′ which can be used more effectively to ensure the formation of a collected body W of material having a desired shape. Like numerals are used to designate like parts in both of FIGS. 5 and 10. No repeated description of those parts is, therefore, made with reference to FIG. 10. The perforated member 18 shown in FIG. 10 has a downwardly protruding portion 18a in its center. A pair of dividing walls 40 are provided between the bottom of the collecting vessel 12 and the perforated member 18 on the opposite sides, respectively, of the protruding portion 18a. It divides the space between the bottom of the vessel 12 and the perforated member 18 into a first evacuation chamber 12a into which the protruding portion 18a projects, and a pair of second evacuation chambers 12b each located on the opposite side of the first evacuation chamber 12a from each other. An evacuation pipe 41a is connected to the first evacuation chamber 12a. Likewise, an evacuation pipe 41b is connected to each of the second evacuation chambers 12b. A valve V1 is provided in the evacuation pipe 41a. The two evacuation pipes 41b join to form a single line provided with a valve V2. All of the evacuation pipes 41a and 41b lead to a fan or like evacuation device 42. The vessel 12 is provided on its sidewall adjacent to the perforated member 18 with a height sensor 43 for detecting that the mixture M has filled the recess defined by the protruding portion 18a. The sidewall of the vessel 12 is also provided above the sensor 43 with a plurality of height sensors 44 for detecting the height of a layer of the mixture M forming a collected body W of material.

The valve V1 is opened, while the valve V2 is kept closed, immediately after the mixture M has begun to be spread, so that only the first evacuation chamber 12a may be evacuated to draw the mixture M only into the recess defined by the protruding portion 18a. If the mixture M collected on the perforated member 18 reaches the height of the sensor 43, a signal is transmitted to open the valve V2 so that air may also be drawn out of the second evacuation chambers 12b through the pipes 41b. As the collection of the mixture M proceeds, one or more of the height sensors 44 detect the height of the mixture M on the perforated member 18 and output a signal to cause the valve 16 to control the direction in which the mixture M is spread. The supply of air through the valve 16 is discontinued when all of the sensors 44 have detected the height of the collected mixture M forming a collected body W of material having a desired shape.

Figure 11:
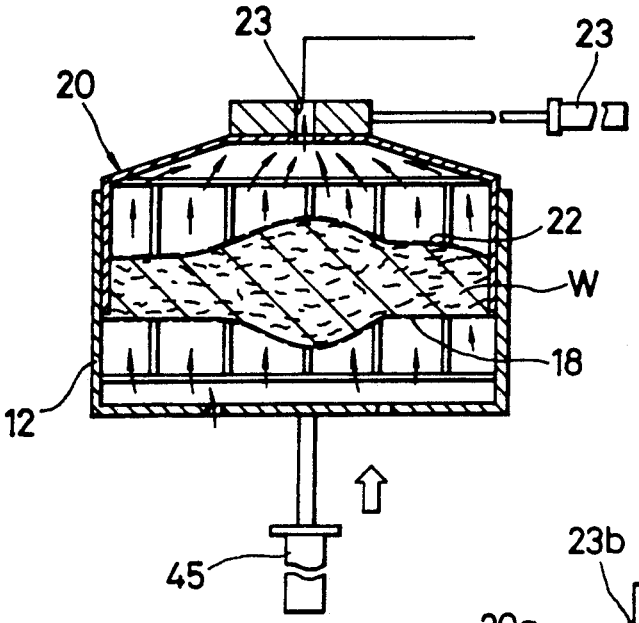

The transfer of the collected body W from the collecting vessel 12 to the holding vessel 20 can be accomplished smoothly if a cylinder is used as shown at 45 in FIG. 11. The cylinder 45 is actuated to raise the vessel 12 so that the body W may be compressed between the perforated member 18 in the vessel 12 and the perforated member 22 in the vessel 20. The, air is drawn out of the holding vessel 20 so that the body W may be attracted against the perforated member 22, and the cylinder 45 is actuated to lower the collecting vessel 12. This method of transfer ensures the prevention of the body W from deformation or displacement, since the body W does not float in the air even momentarily during its transfer, as is apparent from the foregoing description. It is sufficient to use a small evacuation device, as it is sufficient to draw only a small amount of air to attract the body W against the perforated member 22.

Figure 12:
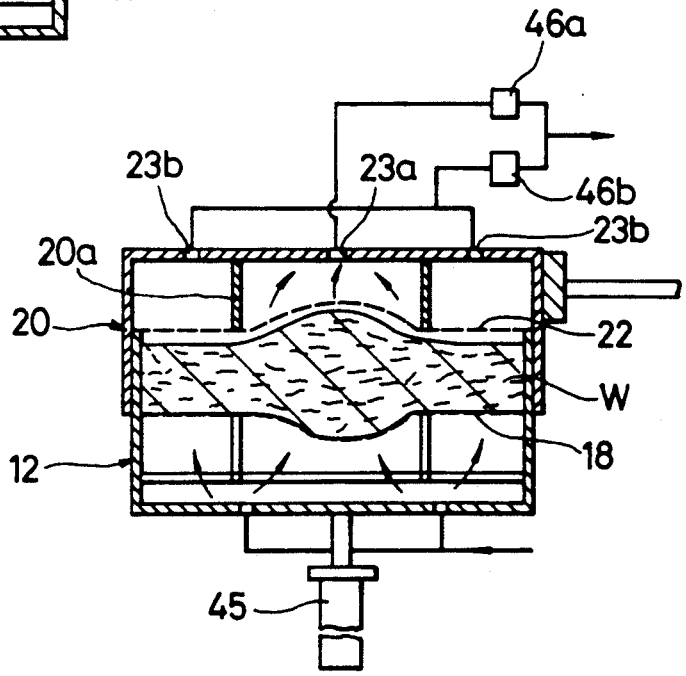

Another arrangement is shown in FIG. 12 and is also useful for accomplishing the smooth transfer of the body W. The holding vessel 20 is provided with a dividing wall 20a which divides the space between the bottom of the vessel 20 and the perforated member 22 into a central portion and a peripheral portion which are provided with independent exit ports 23a and 23b. The port 23a of the central portion is connected to an evacuation device (not shown) by a line provided with a valve 46a, and the ports 23b of the peripheral portion by a line provided with a valve 46b. The vessel 12 is raised by a cylinder 45 and, when the upper surface of the body W has been brought to a level close to the perforated member 22 in the holding vessel 20, the valve 46a is opened to draw air out of the central portion of the vessel 20 through the port 23a. Then, the valve 46b is also opened to draw air out of the peripheral portion through the ports 23b, whereby the body W is brought into intimate contact with the perforated member 22. In other words, the central portion of the body W is held against the perforated member 22 earlier than its peripheral portion. This ensures the transfer of the body W without causing any displacement or deformation thereof. Alternatively, it is possible to divide the inner space of the holding vessel 20 into more portions than are shown in FIG. 12, so that they may be evacuated with a time lag one after another. Moreover, it is, of course, possible to combine the methods as hereinabove described with reference to FIGS. 11 and 12.

Figure 13:
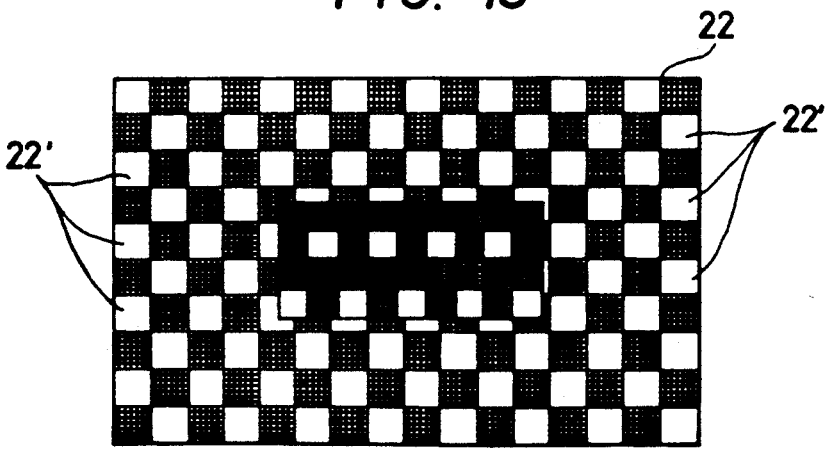

The perforated member 22 in the holding vessel 20 is shown by way of example in FIG. 13. It comprises a wire net to which masking tapes 22' are bonded. The tapes 22' masking the central portion of the perforated member 22 have a different pattern from that of the tapes 22' masking its peripheral portion. This arrangement enables air to flow at different rates through the central and peripheral portions of the member 22 and thereby create different forces of attraction therebetween. In this way, it is possible to prevent any undesirable delay in the attraction of the greater thickness portion of the body W and thereby any deformation of the body W.

Figure 14:
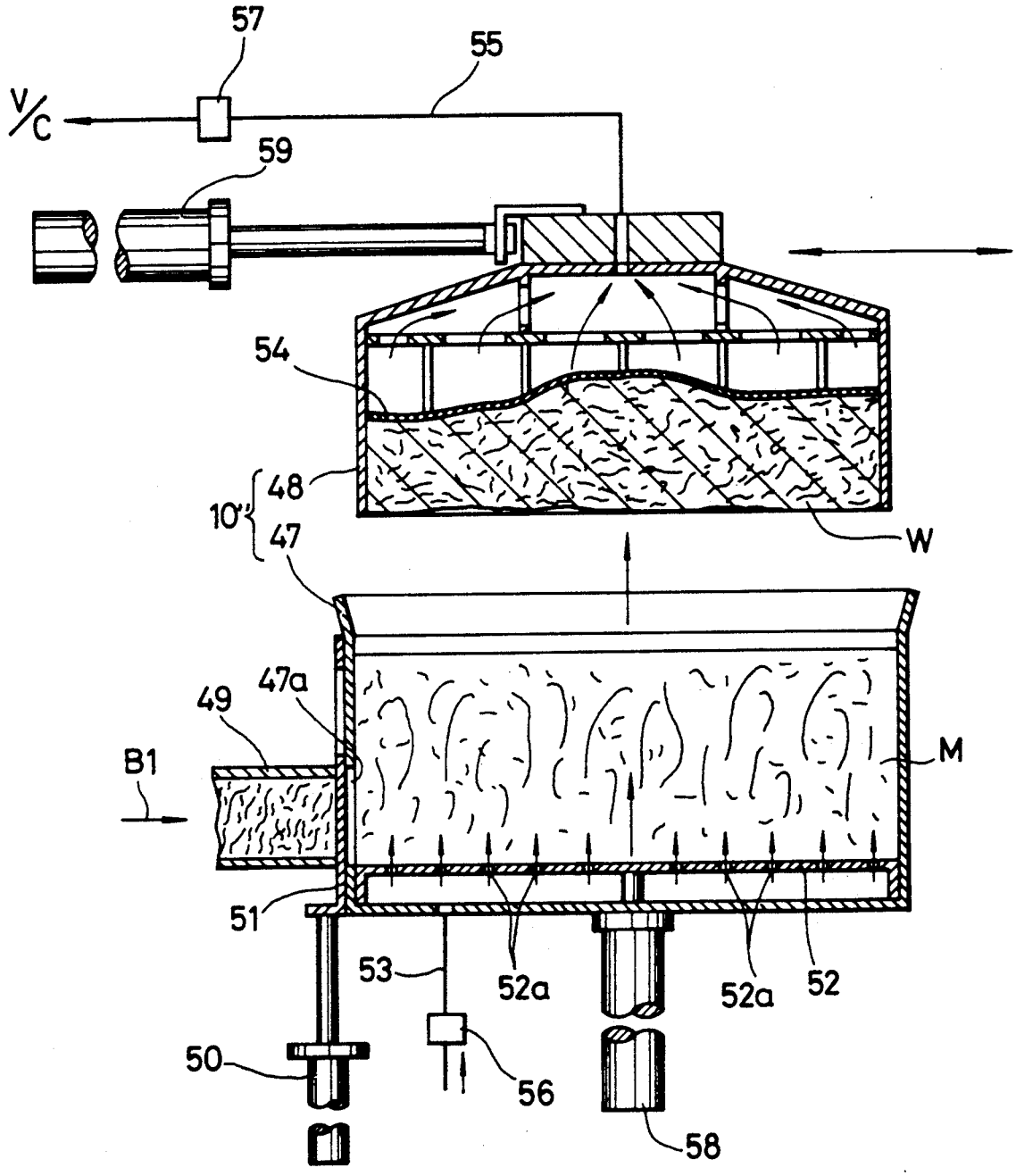

Another type of device for forming a collected body W of material is shown at 10'' in FIG. 14. The collecting device 10'' essentially comprises a fluidizing vessel 47 for supporting the mixture M in a floating position, and a collecting vessel 48 for drawing the mixture M from the fluidizing vessel 47 and forming it into a body having a particular shape. The fluidizing vessel 47 has a sidewall provided with an opening 47a to which a pipe 49 for supplying the mixture M under pressure is connected. A door 51 is provided between the vessel 47 and the pipe 49. The door 51 is vertically movable by a cylinder 50 for opening or closing the opening 47a. The vessel 47 is provided with a perforated member 52 at the bottom thereof. A pipe 53 is connected to the bottom of the vessel 47 to supply air from a compressor (not shown), so that the air may flow up the vessel 47 through the holes 52a of the perforated member 52. A perforated member 54 is provided in the collecting vessel 48 and may, for example, comprise a wire net or a punched metal plate. A pipeline 55 having one end connected to an evacuation device (not shown) is connected at the other end thereof to the closed bottom of the collecting vessel 48. A valve 56 is provided in the pipeline 53 and a valve 57 in the pipeline 55. The fluidizing vessel 47 is vertically movable by a cylinder 58 and the collecting vessel 48 is horizontally movable by a cylinder 59.

If the door 51 is opened, the mixture M is supplied into the fluidizing vessel 47 through the pipe 49 and, when an appropriate amount of the mixture M has been supplied into the vessel 47, the door 51 is closed. Air is supplied from the compressor (not shown) into the bottom of the vessel 47 to create a stream of air flowing upwardly through the perforated member 52. This stream of air fluidizes the mixture M and supports it in a floating position. The cylinder 58 is actuated to raise the vessel 47 and join it with the collecting vessel 48, while the evacuation device (not shown) is operated to evacuate the vessel 48. As a result, the floating mixture M is gradually attracted to gather on the perforated member 54 in the vessel 48 and eventually forms a collected body W of material having a particular shape. The operation of the evacuation device is continued so that the vessel 48 may hold the body W on the perforated member 54. The cylinder 59 is actuated to move the vessel 48 horizontally to a position above the lower half 31 of the mold 30 (FIG. 8). Then the operation of the evacuation device is discontinued so that the body W may be lowered into the lower mold half 31.

Figure 15:
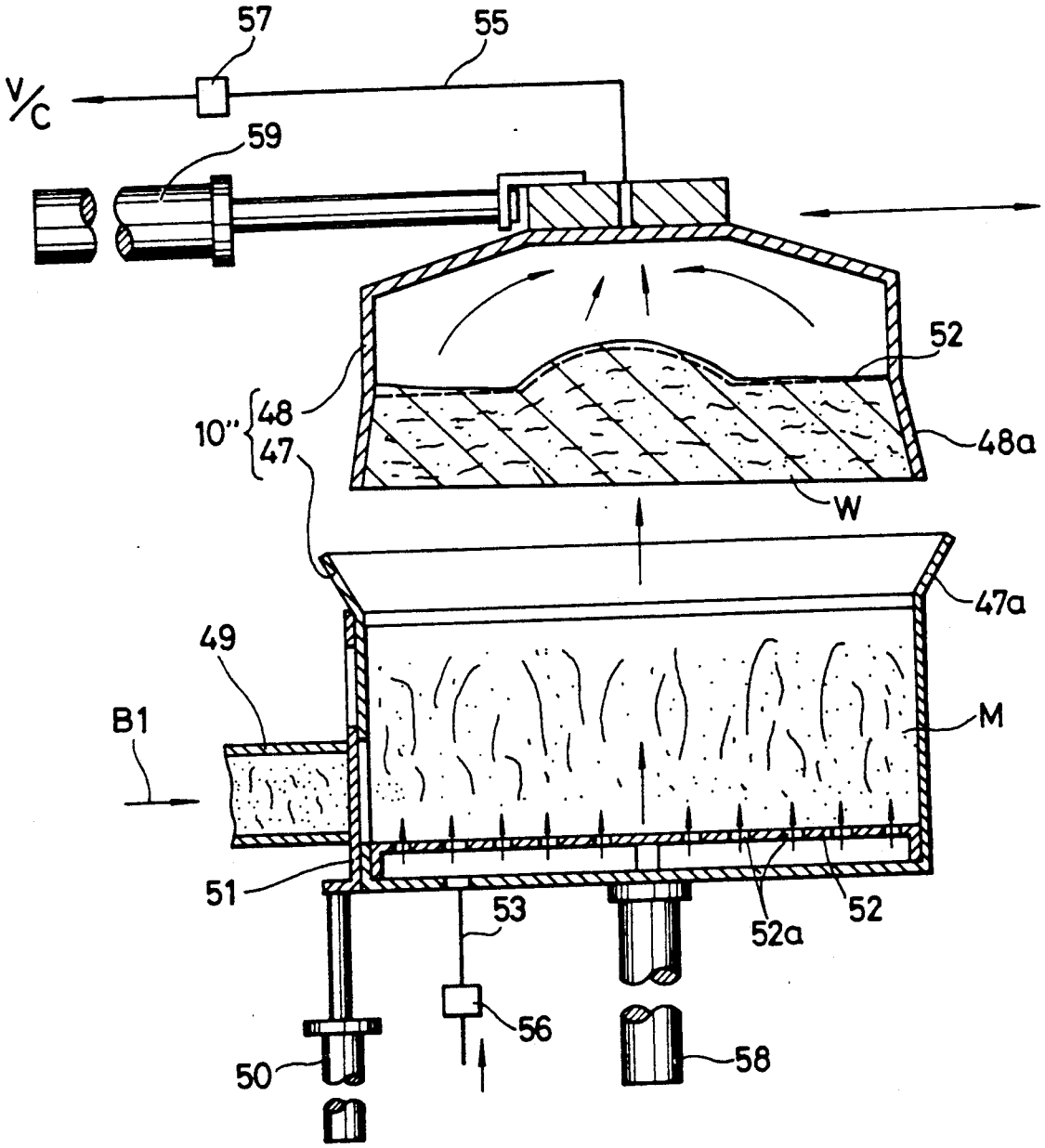

A modified form of the collecting device 10'' is shown in FIG. 15. The collecting vessel 48 has an outwardly inclined sidewall portion 48a terminating at the open end thereof. The inclined sidewall portion 48a facilitates the removal of the body W from the vessel 48 into the mold 30 and prevents any undesirable deformation of the body W during its transfer into the mold.

Figure 16:
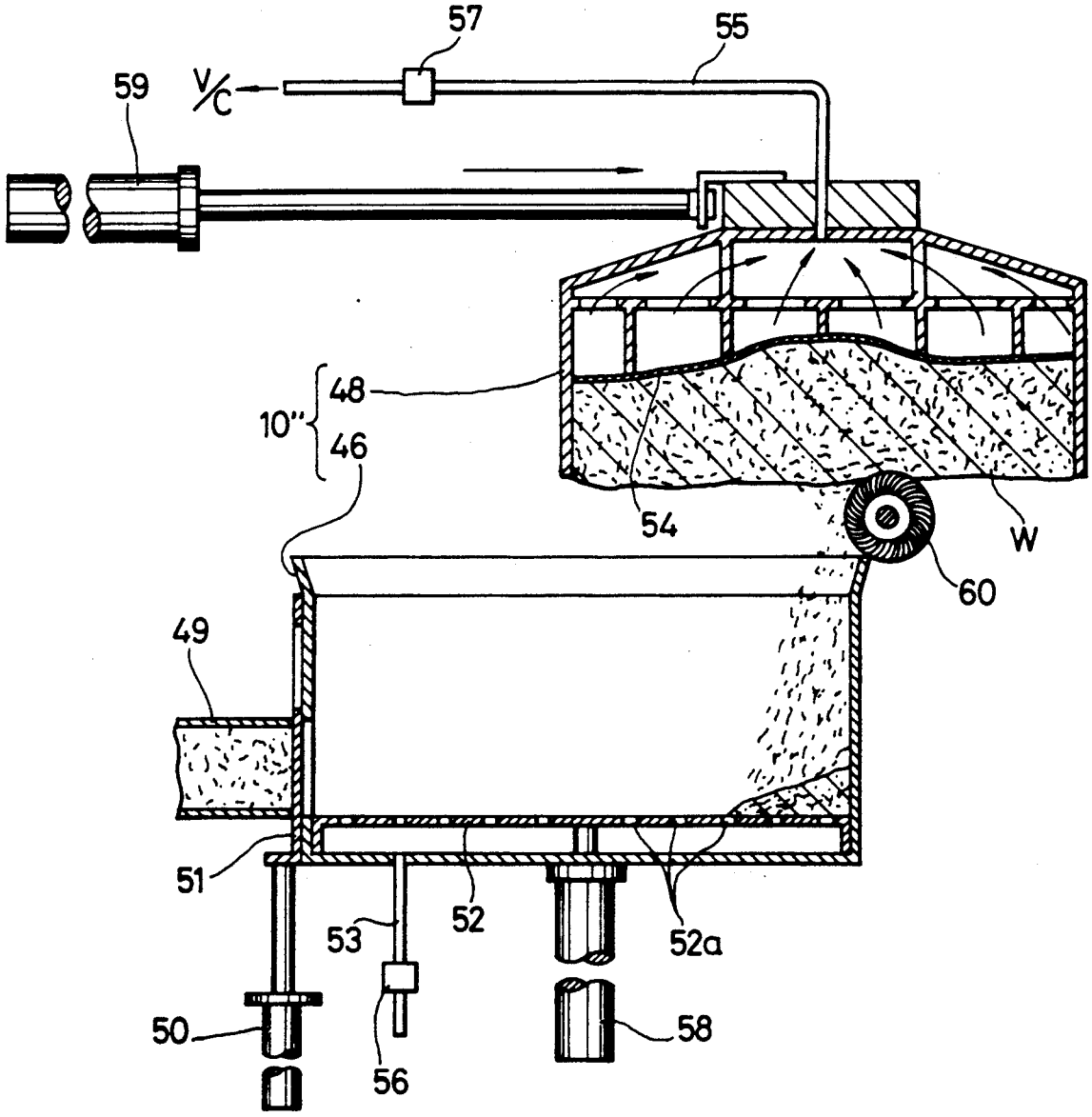

Another modified form of the collecting device 10'' is shown in FIG. 16. It includes a cutter 60 provided along a path which the collecting vessel 48 follows when it is horizontally moved. The cutter 60 may, for example, comprise a wheel brush or a comb. It is useful for flattening the bottom surface of the body W when the vessel 48 is moved to the mold 30.

It is, of course, possible to provide the holding vessel 20 (FIGS. 6 and 7), too, with an outwardly inclined sidewall portion which is similar to the portion 48*a* of the collecting vessel 48 (FIG. 15). It is also possible to provide the cutter 60 in a path along which the holding vessel 20 (FIGS. 6, 7, 11 and 12) carrying the body W is moved.

It is possible to move the collecting vessel itself for conveying a collected body W of material formed therein to the mold 30, instead of using the holding vessel 20 as hereinabove described for conveying the body W from the vessel 12 to the mold with reference to FIGS. 5 and 10. A collecting vessel which is useful for that purpose is shown at 12' in FIG. 17. The vessel 12' is provided with a slidable bottom plate 61. The bottom plate 61 is horizontally slidable by a driving mechanism which comprises a rack 62 provided on the bottom plate 61, a pinion 63 meshing with the rack 62, and a motor 64 for rotating the pinion 63. The vessel 12' as a whole is movable by a cylinder 65 between the spreading vessel 11 (FIG. 5 or 10) and the mold 30. The vessel 12' has no perforated member corresponding to the member 18 which has hereinabove bee described.

A collected body W of material is formed directly on the bottom plate 61, and the vessel 12' as a whole is horizontally moved by the cylinder 65 to a position exactly above the lower half 31 of the mold 30. If the motor 64 is then driven to open the bottom plate 61, the collected body W falls on the lower mold half 31. The use of the vessel 12' can quicken the transfer of the body W to the mold 30 and can also simplify the whole apparatus. Although the bottom plate 61 is shown in FIG. 17 as comprising a single plate, it is, of course, possible to use a pair of bottom plates which are movable to and away from each other.

Figure 17:
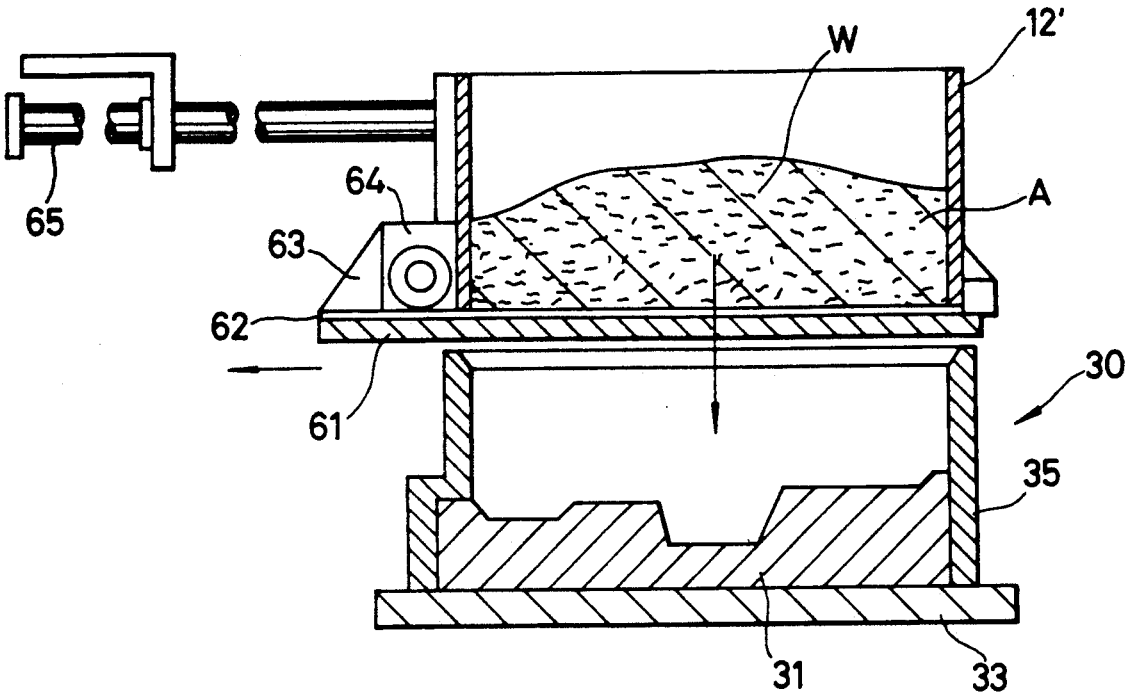

The features as hereinabove described with reference to FIG. 17 are applicable to the collecting vessel 12 having a perforated member 18 as shown in FIG. 5 or 10. The vessel 12 can be modified appropriately if a cylinder of the type shown at 65 in FIG. 17 is provided for moving the vessel 12 horizontally, and if a device for inverting the vessel 12 is provided. When a collected body W of material has been formed in the vessel 12, it is inverted, while the operation of the evacuation device is continued for drawing out air through the evacuation pipe 17 (FIG. 5) or the evacuation pipes 41*a* and 41*b* (FIG. 10). If the vessel 12 has been brought above the lower half of the mold, the operation of the evacuation device is discontinued.

Figure 18:
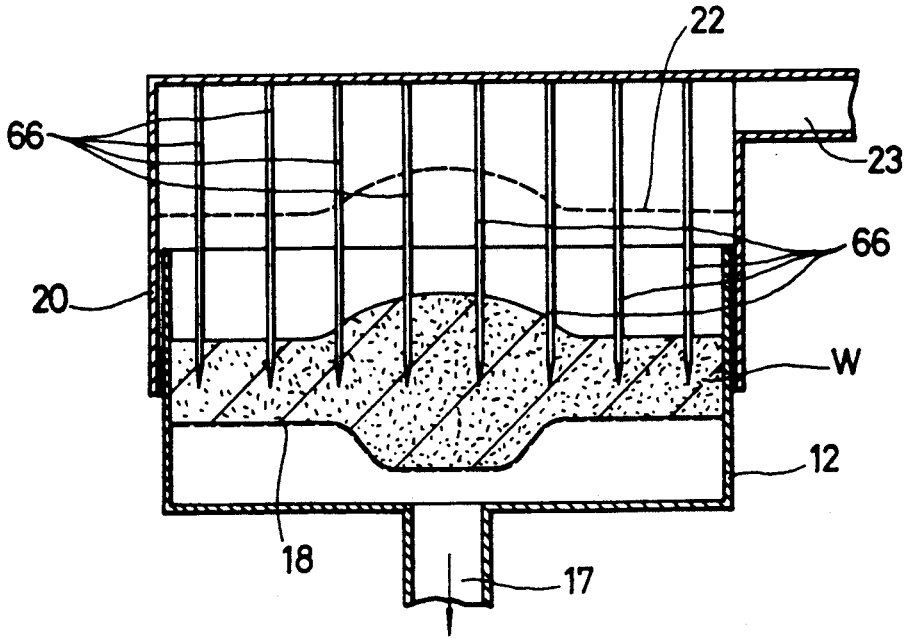
Figure 19:
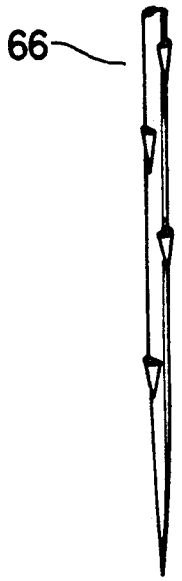
Figure 20:
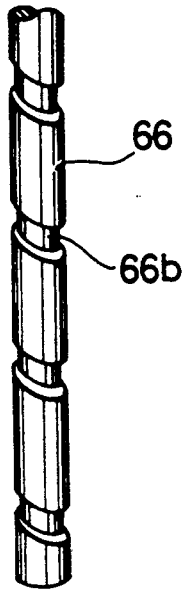

It is important to prevent the deformation or displacement of a collected body W of material when it is conveyed to the mold 30 by the holding vessel 20 (FIGS. 6 and 7) or the collecting vessel 48 (FIG. 14). The prevention of any such problem can be ensured by a feature which is shown by way of example in FIG. 18. The holding vessel 20 (or the collecting vessel 48) is provided with a plurality of needles 66 extending downwardly through the perforated member 22. The needles 66 are pierced into the collected body W when it is transferred from the collecting vessel 12 to the holding vessel 20. Each needle 66 has a plurality of projections 66*a* on its surface as shown in FIG. 19, so that they can firmly catch the body W. The holding vessel 20 protects the body W against deformation and displacement throughout its transfer to the mold 30 and thereby ensures the stability of the subsequent molding operation. A modified form of the needle 66 is shown in FIG. 20. It has a spiral groove 66*b*, as on a drill bit. If it is rotated, it can be pierced into a collected body W of material.

When it is necessary to manufacture a molded wooden product having a deeply drawn portion, it is advantageous to form a collected body W of material with a portion of enlarged thickness corresponding in position to the desired deeply drawn portion in order to increase its compression moldability, as hereinbefore stated. There is, however, every likelihood that the portion of enlarged thickness may fracture during the molding operation, as it is subjected to a high molding pressure before the wooden fibers are sufficiently intertwined.

Figure 21:
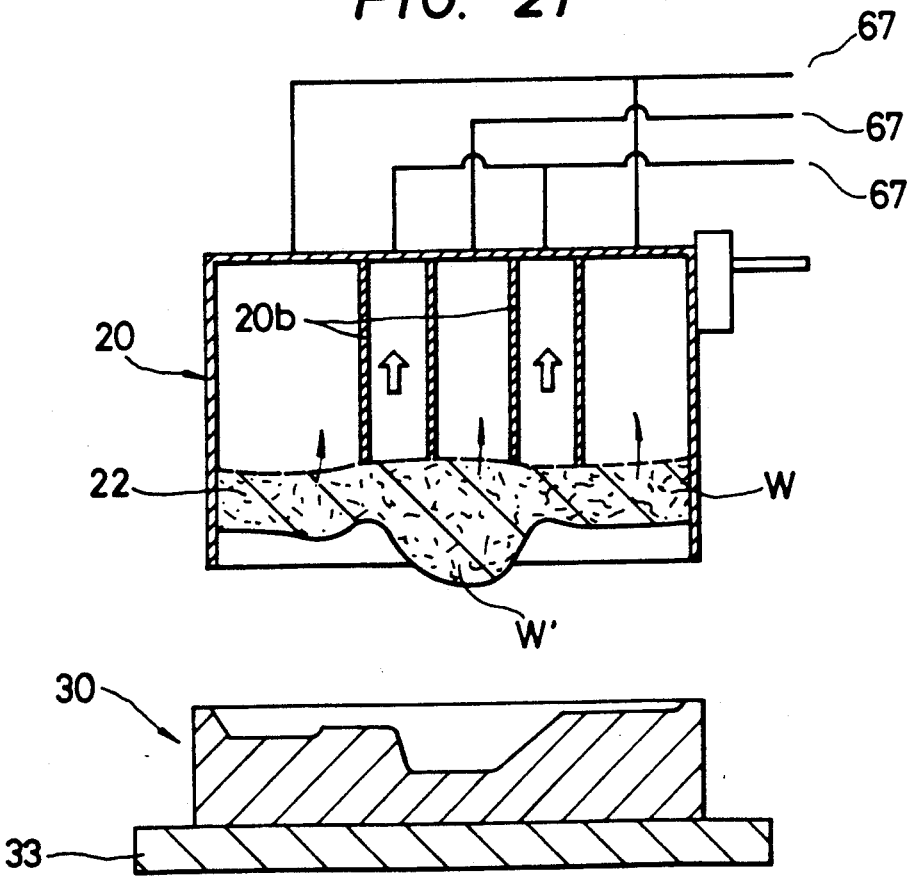

It is, therefore, effective to subject a collected body W of material to preliminary treatment for promoting the intertwining of wooden fibers in its portion of enlarged thickness before it is transferred to the mold 30 by the holding vessel 20 (FIGS. 6 and 7) or the collecting vessel 48 (FIG. 14). A method for such preliminary treatment is shown by way of example in FIG. 21. A plurality of dividing walls 20*b* are provided for dividing the inner space of the holding vessel 20 (or the collecting vessel 48) between the closed end thereof and the perforated member 22 into a plurality of chambers which are connected to an evacuation device (not shown) through a plurality of mutually independent pipelines 67*a* to 67*c*. The chambers below which the enlarged thickness portion W' of the collected body W is located are evacuated more strongly than the other chambers prior to transfer of the body W to the mold 30, so that the wooden fibers in the enlarged thickness portion W' may be intertwined to an increased extent. The increased intertwining of the fibers eliminates any fear of the portion to be deeply drawn being fractured during its compression in the mold 30.

Figure 22:
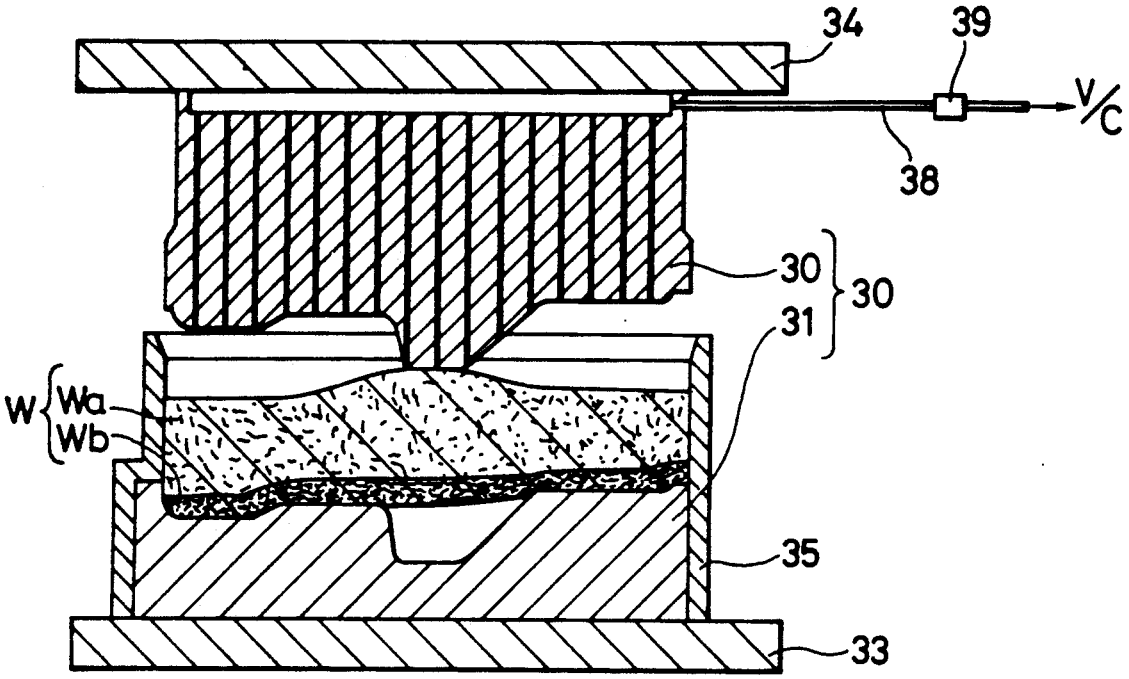

Another way of ensuring the manufacture of a molded product having a deeply drawn portion is shown in FIG. 22. It is characterized by using a collected body W of material composed of a first portion Wa of relatively short fibers and a second portion Wb of relatively long fibers. The second portion Wb is so positioned in the mold 30 as to face its lower half 31 having a cavity into which the material is to be compressed. The second portion Wb has a high degree of expansibility and shape stability due to the satisfactory intertwining of its relative long fibers. It makes up for the insufficient expansibility and shape stability due to the poor intertwining of its relatively short fibers, and thereby contributes to improving the shape stability of the body W as a whole. It is, therefore, possible to obtain a molded product having no fracture in its deeply drawn portion. It is also possible to manufacture a product of uniform density and strength.

Figure 23:
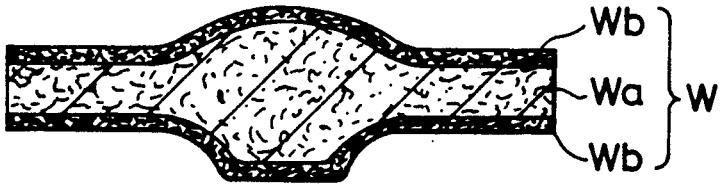
Figure 24:
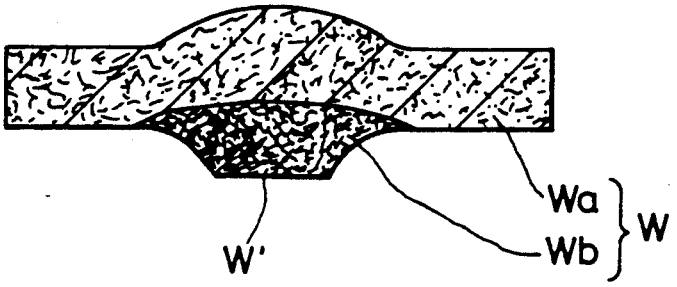

A modified form of the collected body W is shown in FIG. 23. It comprises a first portion Wa and a pair of second portions Wb between which the first portion Wa is sandwiched. Another modified form is shown in FIG. 24. It comprises a first portion Wa and a second portion Wb which forms only a portion W' of enlarged thickness to be deeply drawn.

Figure 25:
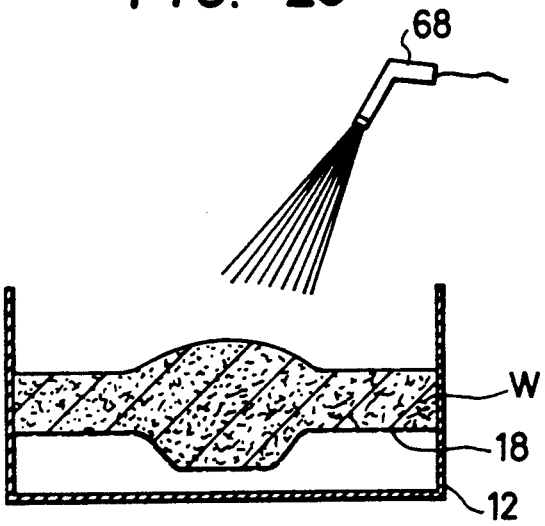
Figure 26:
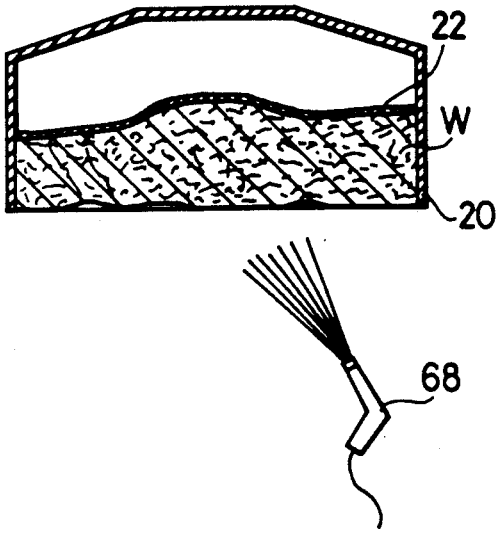
Figure 27:
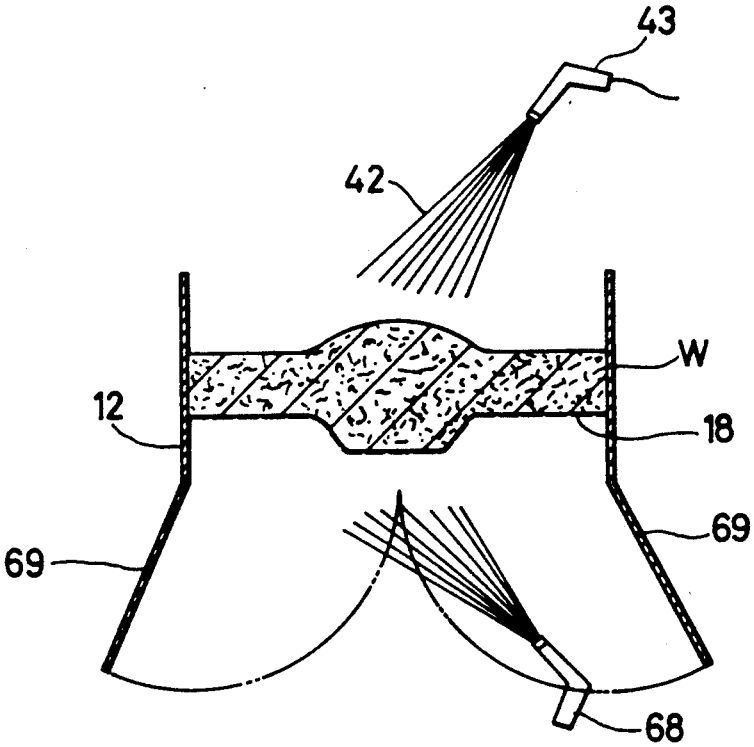

Although the mixture M containing a binder, a mold release agent, or a water-repelling agent has been described as being used to form a collected body of material, it is alternatively possible to form a collected body W and add any such additive thereto. This alternative method is shown by way of example in FIG. 25. After a collected body W of wooden fibers has been formed in the collecting device 10 or 10' (FIG. 5 or 10), the collecting vessel 12 is separated from the spreading vessel 11 and a spray gun 68 is positioned above the vessel 12 for spraying any such additive against the collected body W. Another alternative is shown in FIG. 26. It is characterized by positioning the spray gun 68 below the collected body W which has been transferred from the collecting vessel 12 to the holding vessel 20. Still another alternative is shown in FIG. 27. It is characterized by using a collecting vessel 12 having a bottom 69 which can be opened so that a spray gun 68 may be positioned below the vessel 12 to spray any additive against the body W through the opened bottom 69. All of the arrangements shown in FIGS. 25 to 27 can eliminate the necessity of using the mixer (FIG. 1 or 4), thereby simplifying the manufacturing process, and can also attain a reduction in the consumption of raw materials.

Moreover, it is useful to heat a collected body W of material in situ by using a heat medium such as hot air or steam, since it is thereby possible to omit heating the material when it is compression molded.

What is claimed is:

1. A method of manufacturing a molded wooden product having a deeply drawn portion comprising:

floating, on a gaseous stream, a mixture of wooden fibers containing a binder, onto a first perforated member in a vessel, said first perforated member having a recessed portion corresponding to said deeply drawn portion;

forming a body in a single step by gathering said mixture of fibers on said first perforated member in said vessel;

attracting said body against a second perforated member in said vessel;

removing said body from said vessel;

delivering said body to a compression mold; and compression molding said body under heat to form said product having a deeply drawn portion.

2. A method as set forth in claim 1 wherein said mixture is floated on a stream of air.

3. A method as set forth in claim 1, wherein at least one selected portion of said body is attracted against said first perforated member in said vessel at a different time than other portions of said body.

4. A method as set forth in claim 1, wherein said attraction against said second perforated member in said vessel is terminated when said body has been brought to a position above said mold.

5. A method as set forth in claim 4, wherein said second perforated member in said vessel is strongly attracted to that portion of said body which will be deeply drawn when said body is molded, before said termination occurs.

6. A method as set forth in claim 1, further comprising piercing a plurality of needles into said body before it is conveyed to said mold.

7. A method as set forth in claim 1, further comprising shaping at least one surface of said body with a cutter provided in a path along which said body is conveyed to said mold.

8. A method as set forth in claim 1, wherein said mixture of fibers and binder is fluidized before it is gathered to form said body.

9. A method as set forth in claim 8, further comprising piercing a plurality of needles into said body before it is conveyed to said mold.

10. A method as set forth in claim 1, wherein said body is heated with a heat medium selected from hot air and stream prior to delivering said body to said mold.

11. A method as set forth in claim 8, further comprising shaping at least one surface of said body with a cutter provided in a path along which said body is conveyed to said mold.

12. A method as set forth in claim 1, wherein said body has a first portion composed of relatively short fibers and a second portion composed of relatively long fibers.

13. A method as set forth in claim 1, wherein at least one selected portion of said body is attracted against said second perforated member in said vessel at a different time than other portions of said body.

* * * * *

UNITED STATES PATENT AND TRADEMARK OFFICE

CERTIFICATE OF CORRECTION

PATENT NO. : 5,028,374

DATED : July 2, 1991

INVENTOR(S) : Eiichi Imao et al.

It is certified that error appears in the above-identified patent and that said Letters Patent is hereby corrected as shown below:

Title page, after "Inventors:" first line, "Sadao Kieda" should read --Sadao Ikeda--.

Signed and Sealed this

Thirteenth Day of October, 1992

*Attest:*

DOUGLAS B. COMER

*Attesting Officer*

*Acting Commissioner of Patents and Trademarks*